United States Patent [19]

Gee

[11] 4,052,917

[45] Oct. 11, 1977

[54] JAR AND BOTTLE CAP OPENER

[75] Inventor: Beryl Gee, Scarborough, Canada

[73] Assignee: Beryl Gee, Scarborough, Canada

[21] Appl. No.: 761,061

[22] Filed: Jan. 21, 1977

[51] Int. Cl.[2] ..... B67B 7/18

[52] U.S. Cl. ..... 81/3.42; 81/180 B

[58] Field of Search ..... 81/3.4, 3.42, 3.44, 81/180 B

[56] References Cited

U.S. PATENT DOCUMENTS

| | | | |
|---|---|---|---|
| 537,256 | 4/1895 | White | 81/180 B |
| 2,006,073 | 6/1935 | Harrer | 81/180 B |
| 2,669,142 | 2/1954 | Fuller | 81/3.42 |
| 2,719,444 | 10/1955 | Zeller | 81/3.42 |
| 3,604,289 | 9/1971 | Steel | 81/3.42 |

*Primary Examiner*—Jimmy C. Peters

[57] ABSTRACT

A jar and bottle cap opener having a pair of interchangeably sized gripping jaws slid into engagement along a handle with opposite surfaces of a jar or bottle cap and locked into firm gripping engagement therewith. The handle is then rotated to twist off the cap.

5 Claims, 4 Drawing Figures

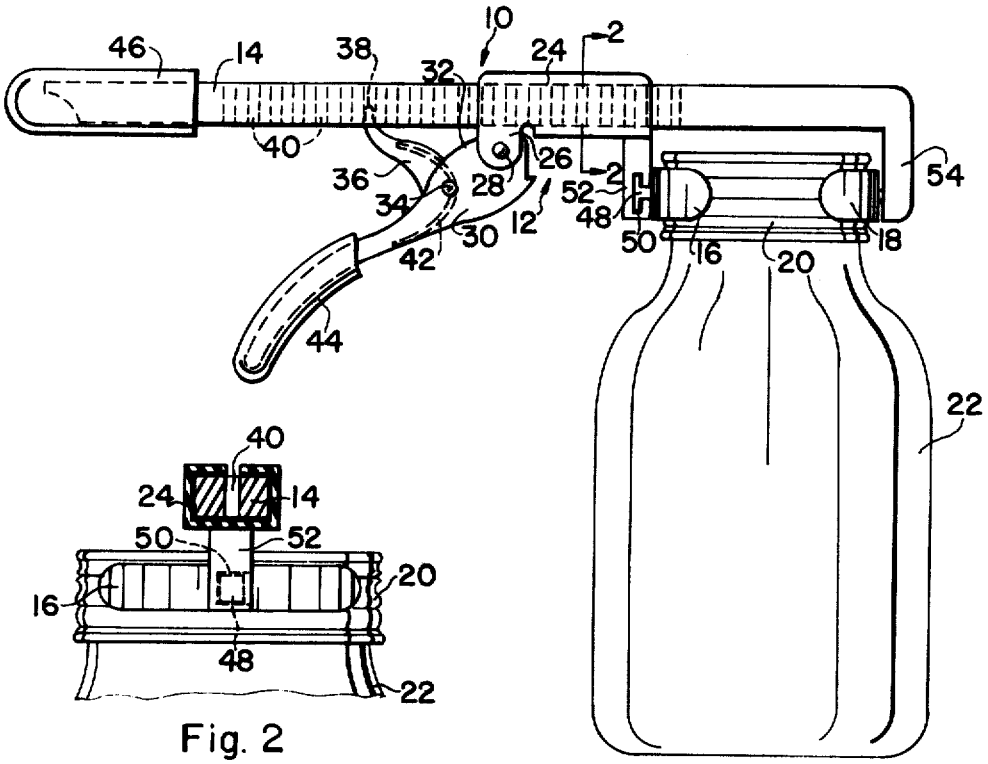
Fig. 1
Fig. 2
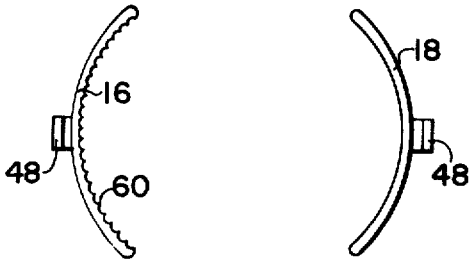
Fig. 3
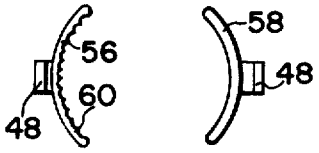
Fig. 4

JAR AND BOTTLE CAP OPENER

BACKGROUND OF THE INVENTION

This invention relates to kitchen tools, and more particularly, to a device for removing screw-type lids and caps from sealed jars and bottles.

It is often difficult to open a jar or bottle having a screw-on lid sealed under vacuum conditions. Accordingly, various devices have been devised to grip the lid and rotate it. Many of these devices include levers for increasing the torque which can be applied to the lid. While such devices have generally proven satisfactory in their operating principles, one drawback has been their inability to provide sufficient gripping surface for contact with the lid as the lids are manufactured in different sizes for different jars and bottles. Claims have been made that if small gripping jaws of minimum curvature are provided, they will universally fit all sizes and shapes of lids. Yet, in actual practice, the high degree of torque which must be applied to twist the lid causes such jaws to slip relative to the lid when a twisting motion is applied thereto. Accordingly, this invention provides a tool for removing screw-type lids and caps which operates on the aforementioned lever principle, but which enables different sized, interchangeable jaws to be used with the device to apply a torque to different sized lids.

SUMMARY OF THE INVENTION

In accordance with the invention, the tool includes a cam mechanism slidable along an elongated handle which exerts a pressure when activated to cause a pair of arcuate gripping jaws to firmly engage opposite portions of a jar or bottle lid so that when the handle is rotated, it will twist off the lid. The jaws are connected to a T-shaped mounting leg slidably received in a slot in the cam mechanism so that a jaw may be quickly removed and interchanged with another sized jaw depending upon the size of the lid to be removed by the tool.

BRIEF DESCRIPTION OF THE DRAWING

Further objects and advantages of the invention will become apparent from the following description and claims, and from the accompanying drawing, wherein;

FIG. 1 is a side view in elevation of the jar and bottle cap opener of the present invention applied to a twist-off lid of a jar;

FIG. 2 is a cross-sectional view taken substantially along the plane indicated by line 2—2 of FIG. 1;

FIG. 3 is a top plan view of a pair of gripping jaws used with the opener of FIG. 1; and FIG. 4 is a top plan view of another pair of gripping jaws interchangeable with the jaws of FIG. 3.

DETAILED DESCRIPTION OF THE PREFERRED EMBODIMENT

Referring now to the drawing in detail, wherein like numerals indicate like elements throughout the several views, the jar and bottle cap opener 10 of the present invention includes a cam mechanism 12 slidable along an elongated handle 14 to exert a force, when activated, to cause a pair of arcuate gripping jaws 16, 18 to firmly engage opposite portions of a jar or bottle lid 20 on a jar or bottle 22 so that when the handle 14 is rotated, the jaws 16, 18 will twist off lid 20.

Cam mechanism 12 includes a generally U-shaped slide 24 received on handle 14. Pivotably mounted between ears 26 depending from one end of slide 24 by a pin is an elongated cammin element 30 having an upper arcuate camming surface 32. Pivotably connected by a pin 34 to an intermediate portion of element 30 is a keeper element 36 having an end 38 received within one of a plurality of holes 40 formed in the bottom surface of handle 14. Cam element 30 and keeper element 36 are urged apart by a leaf spring 42 wound about pivot pin 34 and having a portion in contact with each element. Cam element 30 and handle 14 are provided with vinyl plastic covers 44 and 46, respectively.

Each of the jaws 16, 18 includes a T-shaped mounting lug 48 extending rearwardly from the center thereof. The lug 48 on jaw 16 is slidably received in a complementally shaped slot 50 in the side of a depending lug 52 on a front end of slide 24. The lug 48 on jaw 18 fits into a similar slot in the opposite side of a depending lug 54 on the front of handle 14. Because of mounting lugs 48 and slots 50, jaws 16, 18 may be quickly interchanged with gripping jaws 56, 58 having a different radius of curvature depending upon the size of the lid 20 to be removed by tool 10.

One of the jaws 16, 18 or 56, 58 includes a serrated gripping surface 60 for firmly engaging the lid periphery upon use of the opener 10 in the following manner:

Cam element 30 is pivoted in a counter clockwise direction about pin 28 to remove end 38 of keeper element 36 from contact with any of holes 40 and slide 24 is moved forwardly along handle until jaws 16 and 18 are in contact with lid 20. End 38 of keeper element 36 is then placed in the nearest hole 40 and cam element 30 pivoted about pin 34 in a clockwise direction towards handle 14. The position of pivot pin 34 being fixed by insertion of end 38 in a hole 40, cam surface 32 will pivot about pin 28 over center in firm abutment with the bottom of handle 14 pushing jaw 16 forwardly a small amount into firm gripping engagement with lid 20. This position is locked by the engagement of camming surface 32 with the bottom on handle 14. Handle 14 is then twisted to the right in FIG. 2, counter to the direction of slots 50 to twist lid 20 off jar 22.

While a specific embodiment of a jar and bottle cap opener has been disclosed in the foregoing description it will be understood that various modifications within the spirit of the invention may occur to those skilled in the art. Therefore, it is intended that no limitations be placed on the invention except as defined by the scope of the appended claims.

I claim:

1. A jar and bottle cap opener comprising:

an elongated handle having a depending lug at the front thereof;

a slide on said handle having a depending lug at the front thereof;

a slot in the side of each of said lugs, the slot on one of said lugs being on a side opposite to the slot on the other of said lugs;

a pair of arcuate jaws for gripping therebetween a cap on a bottle or jar;

means on each of said jaws slidably received within one of said slots for mounting a jaw on each of said lugs; and means pivotably mounted on said slide for urging said jaws into gripping relation with a cap on a bottle or a jar and for locking said jaws in gripping relation.

2. The opener of claim 1, wherein said slots are T-shaped in cross-section, and said mounting means includes a T-shaped lug extending rearwardly from the center of each of said arcuate jaws.

3. The opener of claim 2, wherein at least one of said jaws has a serrated gripping surface.

4. The opener of claim 2 including a second pair of arcuate jaws interchangeable with said first pair of jaws, said second pair of jaws being of different size than said first pair.

5. The opener of claim 1, wherein said last named means includes:

a cam element pivotably mounted on the rear of said slide;

a keeper element pivotably mounted between the ends of said cam element;

means between said cam element and keeper element for urging said cam element and keeper element apart;

said keeper element having an end insertable within one of a series of holes in the bottom of said handle to fix said keeper element and to provide a fixed pivot point for said cam element relative to said keeper element;

said cam element having an arcuate camming surface pivotable over-center about said slide with respect to a line between said fixed pivot point and said camming surface pivot point to lock said slide relative to said handle and to force said slide forwardly pressing said one jaw on said slide into firm gripping engagement with a jar or bottle cap.

* * * * *